United States Patent [19]

Thomas

[11] 4,094,499

[45] June 13, 1978

[54] DEVICE FOR CONTROLLING THE ACTUATION OF GRIPPING MEANS IN A SHEET ASSEMBLING APPARATUS

[75] Inventor: Hermann Thomas, Darmstadt, Germany

[73] Assignee: Maschinenfabrik Goebel GmbH, Darmstadt, Germany

[21] Appl. No.: 738,268

[22] Filed: Nov. 2, 1976

[30] Foreign Application Priority Data

Nov. 6, 1975 Germany ..... 2549761

[51] Int. Cl.[2] ..... B65H 39/08

[52] U.S. Cl. ..... 270/60

[58] Field of Search ..... 270/60, 6, 7, 10, 11, 270/13, 14, 19, 38, 42, 47-50, 70-75

[56] References Cited

U.S. PATENT DOCUMENTS 2,026,443 12/1935 Tomlin ..... 270/6

2,797,084 6/1957 Hilgoe ..... 270/60

*Primary Examiner*—Edgar S. Burr

*Assistant Examiner*—A. Heinz

*Attorney, Agent, or Firm*—Watson, Cole, Grindle & Watson

[57] ABSTRACT

A device for controlling the actuation of gripping means provided in a sheet assembling apparatus includes stationary and rotatable cam plates each having different and predetermined profiles, the rotatable cam plate being mounted eccentrically relative to the axis of the sheet collecting cylinder provided for the apparatus. The gripping means includes a follower roll in rolling engagement with the peripheral edge of the stationary cam plate to effect actuation of gripping fingers. The rotatable cam plate rotates together with the cylinder although it is capable of being shifted relative thereto about the cylinder axis whereby to prevent actuation of the gripping means as the follower roll engages at least one portion of the rotatable cam plate which may be shifted to overlie a cam portion of the stationary cam plate.

4 Claims, 3 Drawing Figures

DEVICE FOR CONTROLLING THE ACTUATION OF GRIPPING MEANS IN A SHEET ASSEMBLING APPARATUS

BACKGROUND OF THE INVENTION

This invention relates generally to a device for positively controlling actuation of the gripping means provided on a sheet collecting cylinder in a sheet assembling apparatus. More particularly, the device of the invention includes a cam plate which is rotatable together with the cylinder, is eccentrically mounted relative to the cylinder axis and is shiftable about such axis to move it into and out of phased relationship with the stationary cam plate for controlling actuation of the gripping means as its follower roll is correspondingly prevented and permitted to move along the cam surface of the stationary cam plate.

With the sheet assembling apparatuses of the general type concerned herewith, it is important because of the generally high running speeds required thereof, that the sheets to be assembled are precisely taken-up by the collecting cylinder and are moreover precisely delivered to another sheet handling cylinder as, for example, a folding yaw cylinder. Otherwise, the assembled sheets may be possibly mutilated as the sheet grippers engage the sheets. Moreover, the sheets may become crumpled or creased or otherwise damaged by the grippers. And, if the sheet grippers are inexactly opened and closed, the sheets may become misaligned relative to one another because of such undesired movement of the grippers. Hence, if such sheets are then subsequently handled as by being placed into the folding yaws of a folding yaw cylinder as a folding blade acts on the middle of the sheets, there is a risk that such sheets as assembled and folded collectively are not each folded at their centers because of the misalignment, whereby the individual sheets become even further relative to one another. Quite obviously, such inaccruately folded sheets are undesirable since they spoil the neat appearance of the finished product. Moreover, imprecisely folded sheets may likewise present an obstacle during subsequent handling or manufacture of the sheets.

Disclosed in German Patent No. 10 76 712 is an apparatus for assembling two or more sheets. In such an apparatus it is necessary to readjust the gearing ratio, which is operatively disposed between the collecting cylinder and a cam provided with recesses, in accordance with the quantity of sheets to be assembled in each individual instance. However, this patent does not deal with theproblem of taking-up of the sheets by the collecting cylinder. Such is of exceptional importance, however, when sheets are to be assembled at an ever increasing running speed of the apparatus. Also, the gearing utilized by this apparatus is quite costly and, because of the high running speeds which are required, such gearing may precipitate risks of inaccuracies during movement of the grippers controlled by such cams.

Another related apparatus is disclosed in DL Patent Specificaction No. 67 993 for the control of grippers of pins of a folding apparatus. With such a device it is possible to deliver assembled sheets with a simple as well as with a single-assembled production at two different locations onto cylinders which are adjacent the collecting cylinder. However, this two-fold approach results in increased capital costs, and such a device is less suitable for high running speeds because of the many connections of individual parts required, each one of which presents a source of impairment of the precise motion of the grippers and pins. Moreover, this disclosure fails to deal with the problem of delivering the sheets onto the collecting cylinder.

SUMMARY OF THE INVENTION

It is therefore an object of the present invention to provide a sheet assembling apparatus having means for controlling the sheet gripping means whereby the process of taking-up the assembled sheets by the collecting cylinder is extended to the largest possible sector of the control cam whereby a single-assembled as well as a double-assembled production mode is made possible.

Such objective is attained by the provision of a rotatable cam plate which is mounted eccentrically relative to the collecting cylinder on which the gripping means or other sheet handling devices are mounted. Actuation of such means is determined by the profile of a stationary cam as a follower roll of such means engages a cam portion of the stationary cam plate. The eccentricially rotating cam plate is connected to the collecting cylinder by means of a gearing of a predetermined ratio, and the phase position of the rotatable cam plate is adjustable to the collecting cylinder in functional relationship to the type of sheet handling production. The collecting cylinder and the eccentrically rotating cam plate are interconnected by the common gearing at a ratio correpsonding to the maximum quantity of sheets to be assembled.

The present arrangement features a minimum of sources which might cause an inexact control of the grippers. Accordingly, the accuracy of gripper movement will be maintained to the highest possible degree. And, the device according to the invention requires a minimum of drives as, for example, one transmission only being sufficient for driving the device in such a manner that several types of production, i.e., an unassembled production as well as the assembling of two or more sheets is made possible.

The devices according to the invention can be used in connection with form cylinders of different diameters as well as in connection with collecting cylinders of many different diameters. Moreover, the device is substantially immune from trouble spots of any kind. This is of special importance for devices of the present type since operational problems normally cause considerable downtime for not only the device itself but for the entire production machine. Such downtime for the maching is normally translated into considerable production losses.

By means of the present arrangement an increased period of time is provided for taking-up the sheets to be assembled as the gripping means pass over the cam section of the stationary cam plate. The profile of the stationary cam is therefore comprised of comparatively flat turns thereby causing a slow operation of the grippers and thus assuring the maintenance of the desired movement thereof.

DETAILED DESCRIPTION OF THE INVENTION

Figure 1:
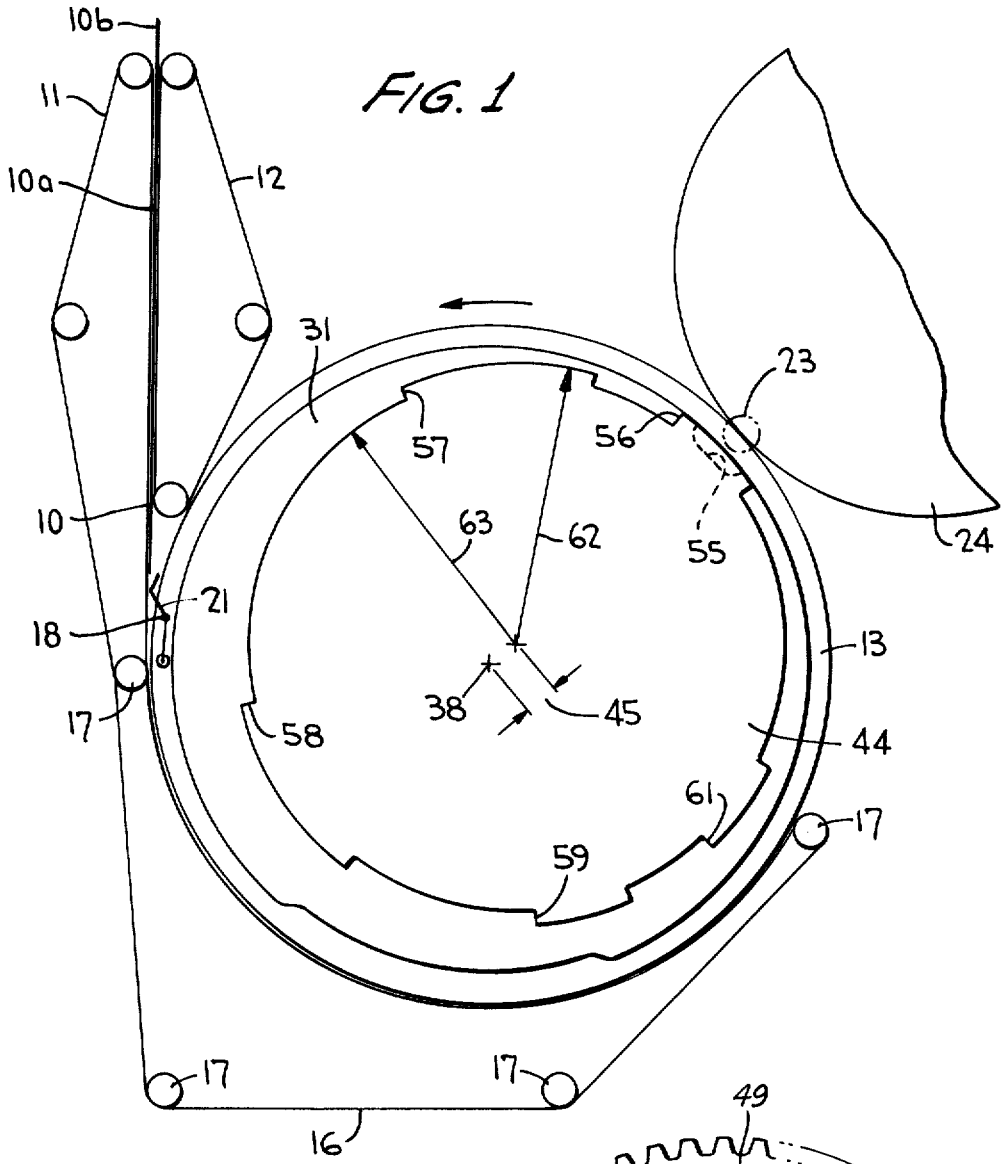
FIG. 1 is a schematic illustration in end elevation of the device according to the invention taken substantially along line 1—1 of FIG. 2, with the bearings of the cam plates being eliminated for the sake of clarity.
Figure 3:
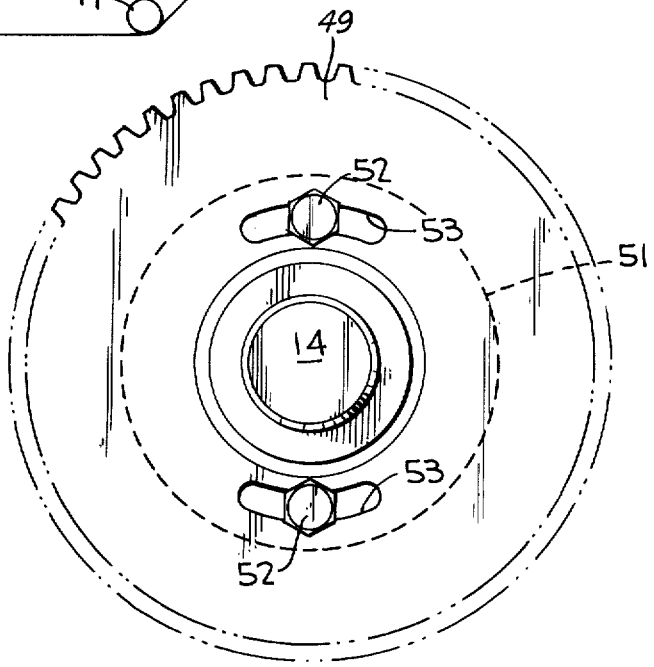
FIG. 3 is a view taken in the direction of arrow 3 of FIG. 2 showing the details of the adjusting mechanism for the rotatable cam plate.

Turning now to the drawings illustrating the device according to the invention, it should be pointed out that unessential elements of the overall machine are omitted for the sake of clarity. Otherwise, like reference characters refer to like and corresponding parts throughout the several view. Sheets 10, 10*a*, 10*b* and so forth, are cut from an elongated web by some suitable cutting means and are fed through the gap between movable tape guides 11 and 12 so as to be guided tangentially toward an assembling or collecting cylinder 13. This cylinder is fixedly mounted on its axial shaft 14 for movement therewith in the direction of the arrow shown in FIG. 1 by some suitable drive means coupled to the shaft through gear 15. Sheets 10, 10*a* and subsequent ones cut or separated from the web are fed in between the peripheral wall of cylinder 13 and a plurality of guide webs or strips 16 disposed adjacent a sector of the cylindrical wall. The strips are mounted in place by means of stationary rollers 17, and one or more gripping devices generally indicated at 18 (only one of such being shown), each having a shaft 19 and one or more gripping finger 21, are operatively mounted on cylinder 13 at predetermined spaced locations depending on the type of operation intended. Each gripping device is likewise provided with a follower roll 22 for effecting opening and closing movement of the gripping fingers. It should be pointed out that the type and manner of retaining the sheets and assembling them, as such, is adequately known by those persons having skill in this art so that it is believed unnecessary to characterize such an operation here. Besides, commonly owned U.S. Pat. No. 3,921,968 generally discloses a collecting cylinder and a gripping device for retaining assembled sheets thereon of the type generally involved here.

As soon as a desired quantity of sheets have been assembled, gripping fingers 21 are made to open for releasing all the assembled sheets at a position such as 23 diagramatically illustrated in FIG. 1 at which the assembled sheets are transmitted onto a handling cylinder 24, which may be a fold ing yaw cylinder. This cylinder is likewise sufficiently known to the skilled artisan and is therefore not described in any detail here.

If during operation, only a single sheet is to be taken-up by collecting cylinder 13, i.e., during what is known as a single production operation, gripping finger(s) 21 must open for release of the sheet each time the gripping device passes through point 23 of delivery. If two sheets are to be assembled one on top of the other on collecting cylinder 13, and then be jointly transmitted onto cylinder 24, the gripping finger(s) must open at point 23 of delivery during each second pass. If three stacked sheets are to be assembled on the collecting cylinder, and be jointly transmitted to cylinder 24, i.e., during what is known as a double-collected production, the gripping finger(s) must open only after each third pass through point 23 of delivery. Accordingly, the opening and closing operation of the grippers must be accurately controlled.

Figure 2:
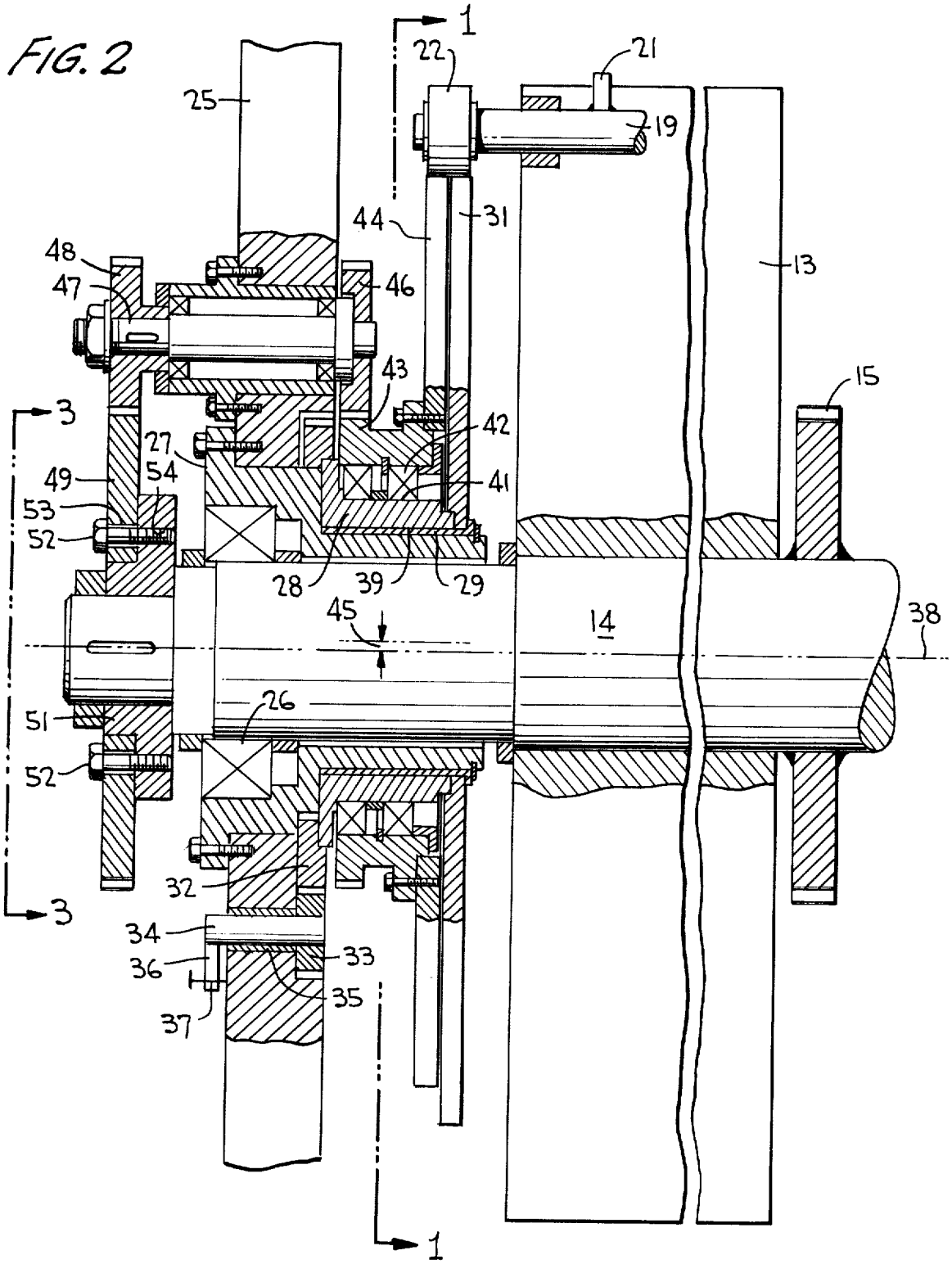
FIG. 2 is a partial section in side elevation of the device according to the invention shown in relation to the collecting cylinder.

The control device according to the invention is substantially illustrated in FIG. 2 of the drawings. Shaft 14 of the collecting cylinder is mounted on frame 25 of the machine for relative rotation by means of a bearing 26. A bushing 27 is fixedly secured to the frame and is disposed between a bearing 26 and the frame. The outer race of bearing 26 is therefore mounted on bushing 27, and another bushing 28 is mounted on bushing 27 for relative rotative movement by means of a bearing 29.

A stationary cam plate 31 is fixedly mounted on bushing 28, such cam plate being stationary since bushing 28 likewise remains stationary during operation of the device. Bearing 29 is provided only for facilitating readjustment of cam plate 31 relative to collecting cylinder 13 by some insignificant amount prior to the start of the production, in order that different sizes of sheet 10 may be assembled by one and the same collecting cylinder 13, and be delivered onto cylinder 24.

A gear 32 is fixedly secured to bushing 28 for the purpose of effecting this size adjustment. Gear 32 intermeshes with another gear 33 which is fixedly connected to a shaft 34 which is mounted for rotation on frame 25 by means of a bearing 35. The desired position of shaft 34 may be adjusted by means of a lever 36 which is fixedly secured to the shaft. A pin 37, displaceably attached to lever 36, is provided for determining the position of lever 36 relative to frame 25. Hence, rotation of shaft 34 effects a corresponding rotation of cam plate 31 about the central axis 38 of cylinder 13.

Bushing 28 is provided with an internal bore, the cylindrical wall 39 of which is disposed concentrically relative to axis 38 of the collecting cylinder. Outside circumference 41 of bushing 28 is, on the other hand, eccentric relative to the internal bore of this bushing, so that a bearing 42 which encircles bushing 28, is eccentrically disposed relative to shaft axis 38. A gear 43 is mounted for relative rotation on bushing 28 by means of bearings 42, and a rotatable cam plate 44 is fixedly secured to gear 43 for rotation together therewith. Accordingly, cam plate 44 is eccentrically mounted for rotation relative to shaft axis 38 of the collecting cylinder. This eccentric spacing is shown at 45 in the drawings.

Gear 43 is meshing engagement with another gear 46 rotatably mounted on frame 25 by means of a shaft 47 to which yet another gear 48 is fixedly secured. A gear 49 is in meshing engagement with gear 48 and is concentrically mounted on shaft 14 by means of a concentrically mounted disk or collar 51. Threaded fasteners such as screws 52 are provided for interconnecting gear 49 and collar 51 together. These screws extend through arcuate elongated slots 53 and engage with pre-tapped holes 54 provided in the collar. The operative diameters and the number of teeth of gears 43, 46, 48 and 49 are so chosen such as to effect a gearing having a constant or a varying ratio depending on the maximum quantity of sheets to be assembled.

Since collar 51 is provided with arcuate and elongated holes 53, gear 49 may be rotated about shaft axis 38 by an according amount and relative to collar 51, after a loosening and retightening manipulation of screws 52. Different phase adjustments are therefore made possible between collar 51 and gear 49 in accordance with the desired type of production.

Since collar 51 is connected to shaft 14 and gear 49 is connected to rotatable cam plate 44 by means of gears 48, 46 and 43, it is possible, after having manipulated screws 52, to effect various phase adjustments of cam plate 44 relative to collecting cylinder 14 by rotating gear 49 relative to collar 51. Cam plate 44 is therefore capable of being rotated about shaft axis 38 to the degree necessary to shift the phase of the rotatable cam plate depending on the type of production desired.

Follower roll 22 is rotatably mounted on the free end of shaft 19 of each gripping device, and is disposed for rolling contact with the peripheral edge of cam plate 31. Hence, when the roll is depressed upon engaging a depressed portion such as 55 provided on the periphery of cam plate 31 and disposed adjacent transfer point 23, the gripping fingers are made to open and subsequently close for the purpose and in a manner well known by those skilled in this art. Roll 22 is of sufficient axial extent so that it may rollingly engage both cam plates 31 and 44. Depending on the functional relationship with the phase adjustment of cam plates 31 and 44 relative to one another, and according to the relative shapes of their profiles, roll 22 may either follow the profile of cam plate 31 alone, or it may follow a combined profile of both cam plates. The profile and the phase adjustment of cam plate 44 and the eccentricity thereof relative to collecting cylinder 13 are selected in such a manner that roll 22 is not capable of following the profile of cam plate 44 at the location wherein sheets 10 arrive at collecting cylinder 13 and therefore may follow only the profile of stantionary cam plate 31. Because of the eccentric arrangement of cam plate 44, there is a very large sector provided for roll 22 to follow on cam plate 31. This sector is disposed at that location where sheets 10, 10*a*, 10*b*, and so forth, are held by cylinder 13.

The profile of known stationary cam plates for a similar use as herein described permit only a limited angle of rotation of the collecting cylinder for opening the gripping fingers thereby resulting in a rather fast opening and closing operation. With the present invention, on the other hand, the sector of cam plate 31 which can be used for opening and closing gripping finger(s) 21 at the point of takeover of the sheets, is quite large because of the eccentric arrangement of cam plate 44. There is thus adequate time for the gripping finger(s) to be opened and closed at the point of takeover. In such manner, roll 22 may precisely follow cam plate 31, and inaccuracies with the movement of the gripping finger(s), as caused by jumping of the cam rolls, are substantially eliminated. Also avoided is the imprecise movement of the gipping finger(s) which in the past has caused damage to the handled sheets.

At the point 23 of delivery, roll 22 can follow the profile of cam plate 31 as well as the profile of cam plate 44. This is brought about by shifting cam plate 44 about shaft axis 38 so as to move a portion thereof such as 56 into a superimposed relationship with depressed portion 55 of cam plate 31, as clearly illustrated in FIG. 1 of the drawings. Moreover, by reason of a pre-selected gear ratio of the gears through which cam plate 44 is connected to the collecting cylinder, portions such as 55 and 56 can be made to coincide, and other portions such as 57, 58, 59 and 61 can be made to coincide with depressed portion 55 once every two or more cylinder revolutions, for example. On the other hand, if no portion of cam plate 44 is made to coincide with depressed portion 55, roll 22 will for course follow only the profile of cam plate 31.

In the device according to the invention only one shaft 19 has been shown for gripping fingers 21, and only one gripping finger has been illustrated. It is obvious that several of such shafts can be arranged at predetermined distances from one another on the collecting cylinder, and the shaft may have several gripping fingers attached thereto and distributed over the width of the collecting cylinder. Also, a stationary cam plate and an eccentrically mounted rotatable cam plate, as aforedescribed, can be associated with both ends of the collecting cylinder. Another set of gearing would, of course, be correspondingly provided for an additional set of cam plates. Moreover, although a gripping device has been described herein, it is within the scope of the present invention to arrange in lieu thereof, pins, folding blades or folding yaws or the like since the control of such devices is similar.

As seen in FIG. 1, raised sectors 56 to 61 provided on cam plate 44 have larger radii 62 than the radius 63 of the remainder of the cam plate. If, because of the selected gear ratio and the eccentricity of cam plate 44, and because of the distribution of the raised sectors, one of which comes to overlie depressed portion 55, roll 22 is not able to follow depression 55 but instead rolls against one of the portions 56 to 61 which is superimposed over the depressed portion. The gripping fingers are therefore maintained in their closed position since they will not have been actuated as before. If cam plate 44, due to its phase adjustment, and because of its gearing ratio has none of its portions 56 to 61 made to overlie depressed portion 55, roll 22 is permitted to follow the profile of cam plate 31 throughout its entirety so that the gripping fingers change in their position and open to thus release the sheets having been assembled on the collecting cylinder whereupon the sheets may pass then onto handling cylinder 24.

Raised sectors 56 to 61 are irregularly distributed over the central angle of cam plate 44 in functional relationship with the maximum quantity of sheets to be assembled. Also, it should be pointed out that sectors having a radial length between 62 and 63 may be provided on cam plate 44 between adjacent pairs of sectors 56 to 61.

Moreover, the present device can also be used with a pair of shafts such as 19 provided wherein one of them has what is known as pre-grippers thereon and the other one having alternating grippers thereon.

Obviously, many other modifications and variations of the present invention are made possible in the light of the above teachings. It is therefore to be understood that within the scope of the appended claims the invention may be practiced otherwise than as specifically described.

What is claimed is:

1. In an apparatus for assembling sheets which comprises a cylinder mounted for rotation about its axis and having a sheet gripping means thereon for holding at least one sheet thereon and for releasing the sheet for passage onto a sheet handling means, the gripping means connected to a follower roll in engagement with a stantionary cam plate having a predetermined profile for effecting actuation of the gripping means as the follower roll engages a depressed portion of the cam plate, a device for further controlling the actuation of the gripping means comprising, a rotatable cam plate eccentrically mounted relative to the cylinder axis, the rotatable cam plate having a profile for preventing actuation of the gripping means when the follower roll simultaneously engages at least one portion of the rotatable cam plate which may overlie a depressed portion of said stationary cam plate and thereby preventing said follower roll from following the profile of the stantionary cam plate, said rotatable cam plate being mounted for rotation about the cylinder axis independent of said stationary cam plate and the cylinder, means for rotating said rotatable cam plate to alter the phase of the rotatable cam plate relative to the cylinder during rotation, and to effect movement of the portion of the rotatable cam plate into and out of an overlying position relative to said depressed portion.

2. In the apparatus according to claim 1, wherein said rotatable cam plate is connected to said cylinder by means of gearing having a predetermined gear ratio.

3. In the apparatus according to claim 2, wherein said gearing has a constant gear ratio for effecting rotation of said rotatable cam plate at the same rate relative to rotation of said cylinder.

4. In an apparatus according to claim 1, wherein said gearing has a variable gear ratio for effecting rotation of said rotatable cam plate at a different rate relative to the rotation of said cylinder, said rotatable cam plate having a plurality of said portions spaced apart in timed relation to said variable gear ratio so as to effect both an overlying and a non-overlying condition of said depressed portion when assembling a plurality of the sheets.

* * * * *